US011396089B2

(12) United States Patent
Kukucka et al.

(10) Patent No.: US 11,396,089 B2
(45) Date of Patent: Jul. 26, 2022

(54) ANTI-SLIP FASTENER REMOVER TOOL

(71) Applicant: GRIP HOLDINGS LLC, Brandon, FL (US)

(72) Inventors: Paul Kukucka, Brandon, FL (US); Thomas Stefan Kukucka, Brandon, FL (US)

(73) Assignee: GRIP HOLDINGS LLC, Brandon, FL (US)

( * ) Notice: Subject to any disclaimer, the term of this patent is extended or adjusted under 35 U.S.C. 154(b) by 0 days.

(21) Appl. No.: 17/231,530

(22) Filed: Apr. 15, 2021

(65) Prior Publication Data

US 2021/0229246 A1 Jul. 29, 2021

Related U.S. Application Data

(63) Continuation-in-part of application No. 16/548,470, filed on Aug. 22, 2019, now Pat. No. 11,045,925, (Continued)

(51) Int. Cl.
*B25B 15/00* (2006.01)
*B25B 23/10* (2006.01)

(52) U.S. Cl.
CPC ..... *B25B 15/005* (2013.01); *B25B 23/105* (2013.01)

(58) Field of Classification Search
CPC ... B25B 15/001; B25B 15/004; B25B 15/005; B25B 23/08; B25B 23/105; B25B 27/18; (Continued)

(56) References Cited

U.S. PATENT DOCUMENTS 6,079,299 A * 6/2000 Sundstrom ..... B25B 13/04 81/121.1
7,225,710 B2 6/2007 Pacheco, Jr.
(Continued)

FOREIGN PATENT DOCUMENTS

DE 29613327 U1 * 9/1996 ..... B25B 13/08
DE 102014212523 B3 * 9/2015 ..... B25B 13/04
(Continued)

OTHER PUBLICATIONS

Translation DE-29613327-U1 (Year: 1996).*
DE-102014212523-B3 translation (Year: 2015).*

*Primary Examiner* — Monica S Carter
*Assistant Examiner* — Abbie E Quann

(57) ABSTRACT

An anti-slip fastener remover tool includes a torque-tool body, a plurality of paired engagement features, and an intersection point. The plurality of paired engagement features that grips the lateral surface of the stripped fastener head is radially positioned around a rotation axis of the torque-tool body. The plurality of paired engagement features, wherein each paired engagement feature is offset by 30 degrees, comprises a first engagement feature and a second engagement feature. The first engagement feature and the second engagement feature each comprises a bracing section, a cavity section, and a connector section that are adjacently connected to each other. The cavity section of the first engagement feature is adjacently connected to the cavity section of the second engagement feature. The bracing sections of the first engagement feature and the second engagement feature are oppositely positioned of each other about the cavity sections of the first and second engagement features.

16 Claims, 9 Drawing Sheets

Related U.S. Application Data which is a continuation-in-part of application No. 16/514,117, filed on Jul. 17, 2019, which is a continuation-in-part of application No. 16/255,341, filed on Jan. 23, 2019, now Pat. No. 11,154,969, application No. 17/231,530, which is a continuation-in-part of application No. 16/107,842, filed on Aug. 21, 2018, now Pat. No. 10,780,556.

(60) Provisional application No. 62/733,507, filed on Sep. 19, 2018.

(58) Field of Classification Search
CPC .... B25B 13/04; B23D 77/00; B23D 2277/20; B27G 13/00; B27G 13/002; B27G 13/02; B27G 13/08
USPC ..... 81/461, 179, 177.75, 53.2
See application file for complete search history.

(56) References Cited

U.S. PATENT DOCUMENTS

| | | | | |
|---|---|---|---|---|
| 10,780,556 | B2 | 9/2020 | Kukucka et al. | |
| 10,967,488 | B2 | 4/2021 | Kukucka et al. | |
| 2006/0266168 | A1 | 11/2006 | Pacheco, Jr. | |
| 2014/0260832 | A1* | 9/2014 | Hsiao | B25B 15/001 81/438 |
| 2015/0266169 | A1* | 9/2015 | Campbell, II | B21K 1/463 81/436 |
| 2018/0354102 | A1 | 12/2018 | Kukucka et al. | |
| 2019/0375077 | A1 | 12/2019 | Kukucka et al. | |
| 2020/0298380 | A1 | 9/2020 | Doroslovac et al. | |

FOREIGN PATENT DOCUMENTS

| | | | |
|---|---|---|---|
| EP | 2363245 | A2 | 9/2011 |
| EP | 2363245 | A3 | 7/2015 |
| WO | WO2015082283 | A1 | 6/2015 |

* cited by examiner

ANTI-SLIP FASTENER REMOVER TOOL

The current application is a continuation-in-part (CIP) application of a U.S. non-provisional application Ser. No. 16/548,470 filed on Aug. 22, 2019. The U.S. non-provisional application Ser. No. 16/548,470 claims priority to a U.S. nonprovisional application Ser. No. 16/514,117 filed on Jul. 17, 2019. The U.S. non-provisional application Ser. No. 16/514,117 claims priority to a U.S. nonprovisional application Ser. No. 16/255,341 filed on Jan. 23, 2019. The U.S. non-provisional application Ser. No. 16/255,341 claims a priority to a U.S. provisional application Ser. No. 62/733,507 filed on Sep. 19, 2018.

The current application is a continuation-in-part (CIP) application of a U.S. non-provisional application Ser. No. 16/107,842 filed on Aug. 21, 2018.

FIELD OF THE INVENTION

The present invention relates generally to tools designed for tightening or loosening fasteners, in particular bolts and nuts. More specifically, the present invention is an anti-slip fastener remover tool that designed to engaged bolts, nuts, and other similar fasteners with little chance of slippage.

BACKGROUND OF THE INVENTION

Hex bolts, nuts, screws, and other similar threaded devices are used to secure and hold multiple components together by being engaged to a complimentary thread, known as a female thread. The general structure of these types of fasteners is a cylindrical shaft with an external thread and a head portion that is connected at one end of the cylindrical shaft. The external thread engages a complimentary female thread tapped into a hole or a nut and secures the fastener in place, fastening the associated components together. The head portion receives an external torque force and is the means by which the fastener is turned, or driven, into the female threading. The head portion is shaped specifically to allow an external tool like a wrench to apply a torque to the fastener in order to rotate the fastener and engage the complimentary female threading to a certain degree. This type of fastener is simple, extremely effective, cheap, and highly popular in modern construction. One of the most common problems in using these types of fasteners, whether male or female, is the tool slipping in the head portion, or slipping on the head portion. This is generally caused by either a worn fastener or tool, corrosion, over-tightening, or damage to the head portion of the fastener. Various methods may be used to remove a fastener, some more aggressive than others. Once a fastener head is damaged, a more aggressive method must be implemented to remove a seized fastener. Drilling out the fastener is a common method used by some users to dislodge the fastener. While this method can prove to be effective in some scenarios there is a high risk of damaging the internal threads of the hole.

The present invention is an anti-slip fastener remover tool that virtually eliminates the chance of slippage. The present invention uses a series of integrated engagement segments that bite into the head portion of the fastener and allow for efficient torque transfer between the extractor bit and the head portion of the fastener. Resultantly, the present invention may be used to tighten or loosen fasteners without worrying about stripping the corners of the fastener.

DETAIL DESCRIPTIONS OF THE INVENTION

Figure 1:
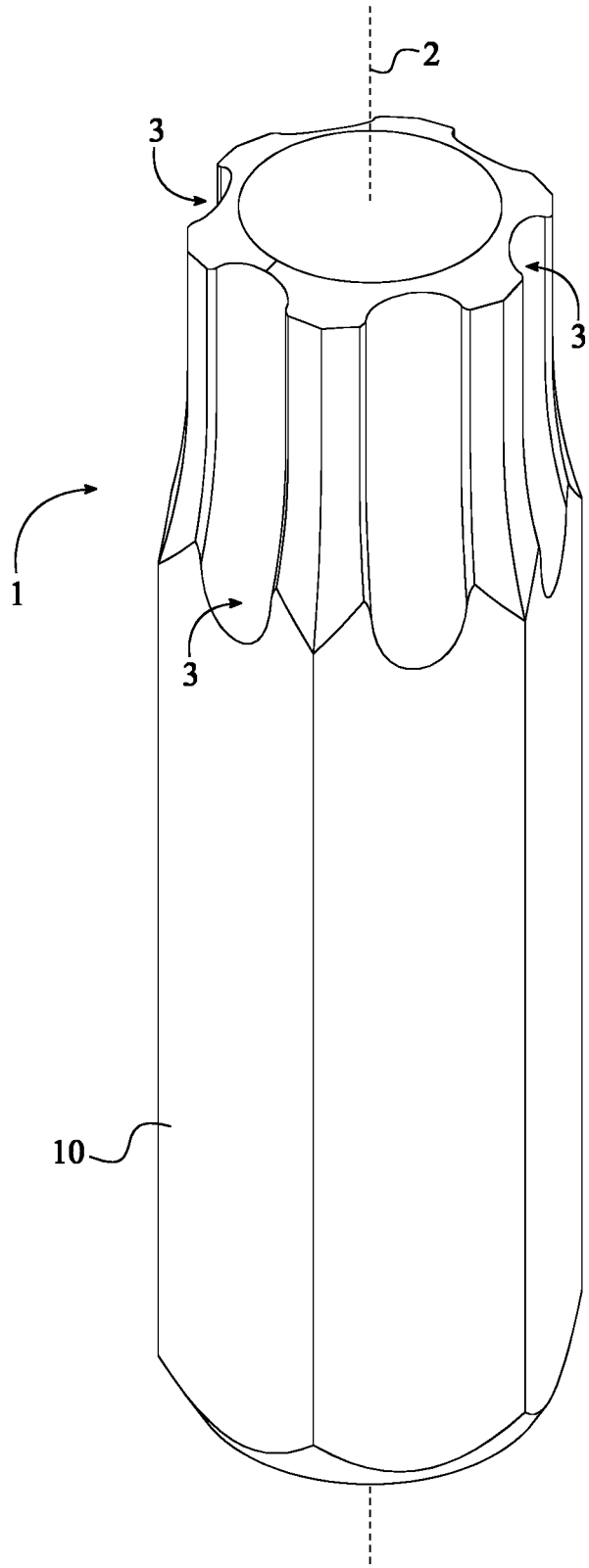
FIG. 1 is a perspective view of the present invention, wherein the torque-tool body is outwardly extended from the rotational axis to the plurality of paired engagement features.
Figure 2:
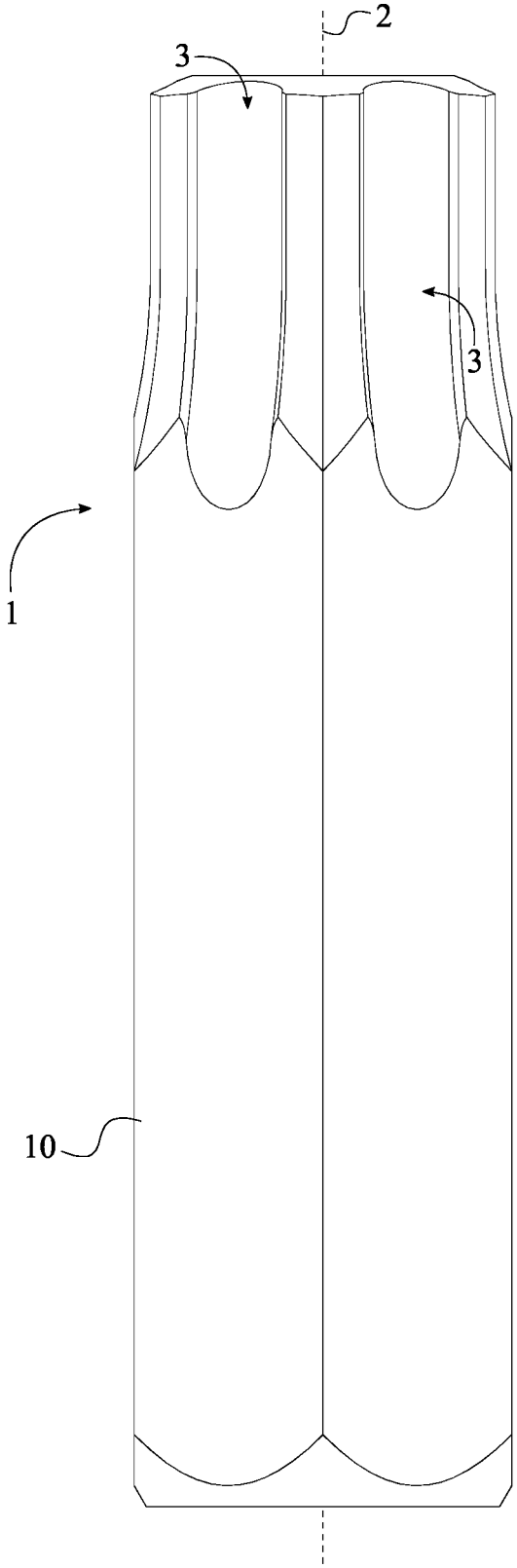
FIG. 2 is a side view of the present invention, wherein the torque-tool body is outwardly extended from the rotational axis to the plurality of paired engagement features.

All illustrations of the drawings are for the purpose of describing selected versions of the present invention and are not intended to limit the scope of the present invention.

The present invention is an anti-slip tool used to tighten or loosen a damaged/stripped fastener such as a nut or bolt. Traditional wrench designs transfer the majority of the torque to the damaged/stripped fastener through the lateral corners of the fastener head. Over time, the degradation of the lateral corners reduces the efficiency of transferring torque from the wrench to the fastener head and, as a result, causes slippage. The present invention overcomes this problem by moving the contact point to the lateral sides of the fastener head. This is accomplished through the use of a multitude of teeth. Each of the teeth is positioned to engage or "bite" the lateral surface of the fastener head instead of the lateral corner. This ensures an adequate amount of torque is transferred to the fastener head to initiate rotation and, resultantly, extraction or tighten the damaged/stripped fastener. However, the present invention is also designed to be used with an undamaged or new fastener without causing damage to the fastener when torque is applied in accordance with maximum specified and industry approved torque levels for the particular fastener size or diameter.

The present invention utilizes a multitude of teeth to engage the sides of the fastener head, damaged or otherwise, in order to efficiently apply torque onto the damaged/stripped fastener. The present invention may be integrated into or utilized by a variety of general tools to increase the torque force applied to a fastener. General tools include, but are not limited to, open-end wrenches, adjustable wrenches, pipe wrenches, socket wrenches, plumber wrench, and other similar fastener engaging tools. The present invention is compatible with female-member based head design fasteners; however, the present invention may be incorporated into a male fastener head design as described in this application. Fasteners which utilize a female-member head design, also known as female fasteners, use the internal cavity of the fastener head to engage a tool for tightening or loosening. Fasteners which utilize a male-member head design, also known as male fasteners, use the external lateral surface of the fastener head to engage a tool for tightening or loosening. In addition, the present invention is compatible with fasteners of a right-hand thread and fasteners of a left-hand thread. Furthermore, the present invention may be altered and configured to fit different types and different sizes of fasteners.

Referring to FIG. 1-4, the present invention comprises a torque-tool body 1, a plurality of paired engagement features 3, and an intersection point 34. The torque-tool body 1 is used as the physical structure to apply the corresponding force by the plurality of paired engagement features 3 on the fastener head. For some fasteners, the torque-tool body 1 functions similar to a driver-bit that is sized to fit into an opening of the fastener head in an interlocking manner. The length, width, and diameter of the torque-tool body 1 may vary to fit different sized male/female fasteners. The plurality of paired engagement features 3 prevents slippage of damaged/stripped fastener during extraction and is radially positioned around a rotational axis 2 of the torque-tool body 1 as seen in FIG. 3-6 and FIG. 8. As a result, the plurality of paired engagement features 3 facilitates the transfer of torque to the male/female fastener by preventing slippage between the torque-tool body 1 and the fastener head. The intersection point 34 is identified as the meeting points of two plurality of paired engagement features 3. In other words, an arbitrary paired engagement feature 32 from the plurality of paired engagement features 3 and an adjacent paired engagement feature 33 from the plurality of paired engagement features 3 are connected to each other through the intersection point 34. Depending upon different embodiments of the present invention, the intersection point 34 can be a sharp point or a curved section similar to a small radius. In some embodiments, the intersection point 34 may incorporate a third segment, wherein the third segment is preferably a straight portion connected between the plurality of paired engagement features 3 of the arbitrary bracing section and an adjacent bracing section 4. More specifically, FIG. 1-7, the torque tool body 1 is a male embodiment designed for use in a female socket type fastener.

The plurality of paired engagement features 3 is distributed into a polygon shape within the torque-tool body 1 and preferably symmetric along the rotational axis 2, wherein the rotational axis 2 centrally traverses through the torque-tool body 1. A symmetrical design is ensured within the present invention to perform equally when rotating the fastener in a clockwise direction or in a counterclockwise direction.

In reference to FIG. 1, the torque-tool body 1 is outwardly extended from the rotational axis 2 to the plurality of paired engagement features 3. This yields the driver-bit structure for the present invention as the plurality of paired engagement features 3 is distributed about the rotational axis 2 on an external surface of the torque-tool body 1. The driver-bit structure of the torque-tool body 1 associates with the opening of the fastener head so that the plurality of paired engagement features 3 can internally engage with the fastener head.

Figure 8:
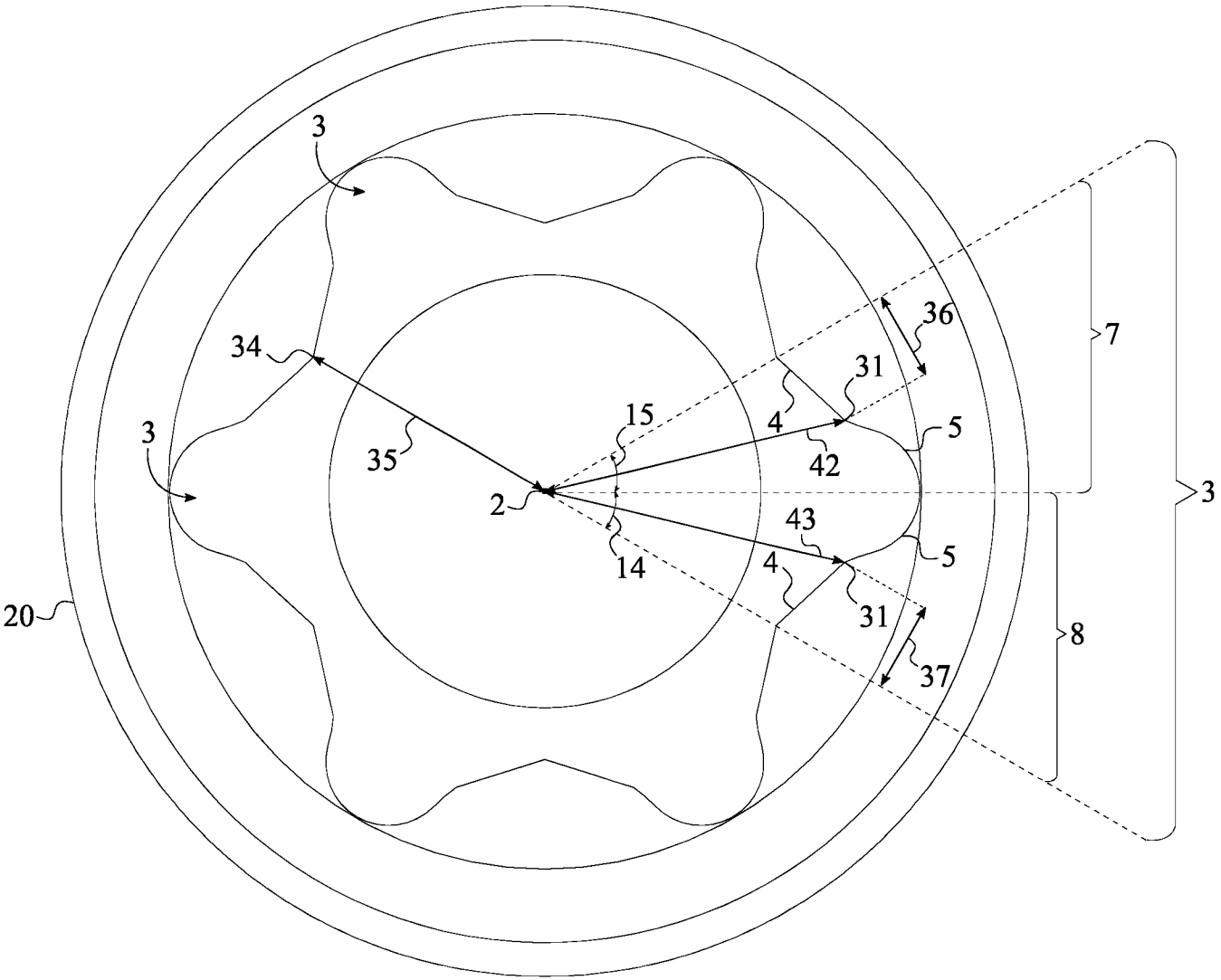
FIG. 8 is a top view of the present invention, wherein the torque-tool body is inwardly extended from the outer wall to the plurality of paired engagement features.
Figure 9:
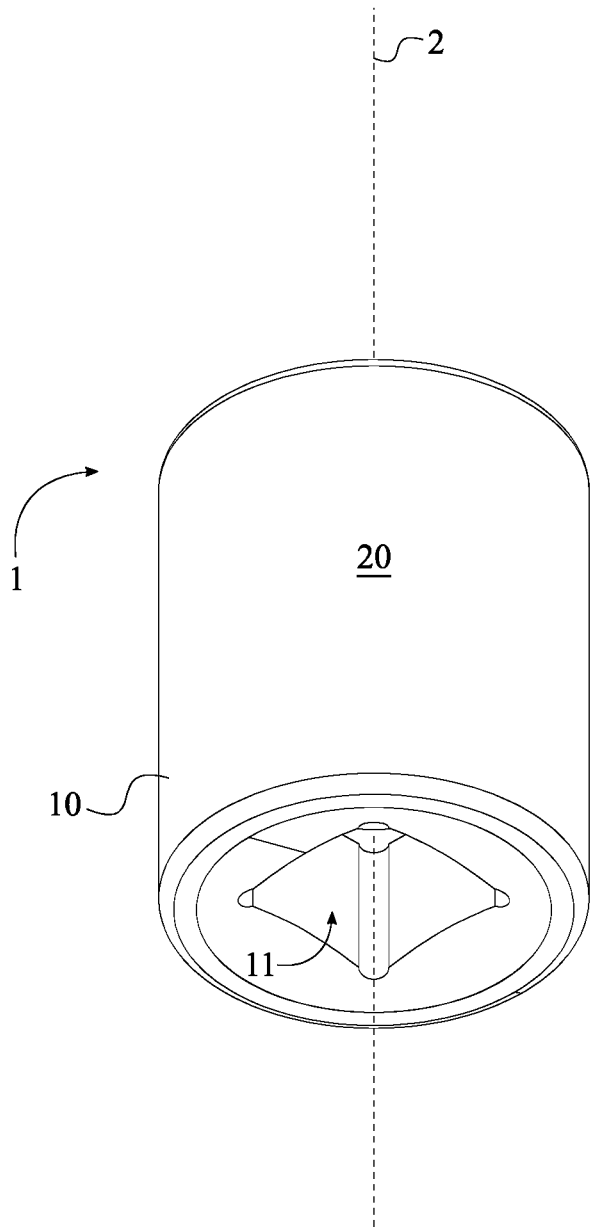
FIG. 9 is a bottom perspective view of the present invention showing the engagement bore.

In reference to FIG. 8-9, the torque-tool body 1 is inwardly extended from an outer wall 20 of the torque-tool body 1 to the plurality of paired engagement features 3. This yields the female-socket structure for the present invention as the plurality of paired engagement features 3 is distributed about the rotational axis 2 on an internal surface of the torque-tool body 1. The female-socket structure of the torque-tool body 1 associates with the lateral surfaces of the fastener head so that the plurality of paired engagement features 3 can externally engage with the fastener head. More specifically, FIG. 8-9, the torque tool body 1 is a female embodiment designed for use on the male surface of a fastener.

The present invention also incorporates an attachment feature which allows an external torque applying tool to attach to the torque-tool body 1 and increase the torque force applied to the fastener head. In reference to FIG. 1-2 and FIG. 8-9, the present invention further comprises an attachment body 10 and an engagement bore 11 that allow an external torque applying tool such as an open ended wrench, a box ended wrench, a combination wrench, an adjustable wrench, and a socket wrench or ratchet wrench to be attached to the torque-tool body 1. The attachment body 10 is centrally positioned around and along the rotational axis 2 in order to align with the axis of rotation of the external torque applying tool. Furthermore, the attachment body 10 is connected adjacent to the torque-tool body 1. The attachment body 10 diameter is preferably and slightly larger than the diameter for the torque-tool body 1. However, the attachment body 10 may incorporate a smaller diameter than the torque-tool body 1 or, the attachment body 10 may incorporate a same size diameter as the torque-tool body 1 depending upon the preferred manufacturing method or design. The engagement bore 11 traverses into the attachment body 10 along the rotational axis 2. The engagement bore 11 is shaped to receive a male attachment member of a socket wrench, wherein the preferred shape of the engagement bore 11 is a square as the majority of socket wrenches utilize a square male attachment member. In alternative embodiments, the shape and design of the engagement bore 11 and the attachment body 10 may vary to be adaptable to different torque applying tools and different attachment means including, but not limited to, square or cylindrical. In an alternative embodiment, an outer surface of the attachment body 10 may have surface griping treatment applied such as knurling or other alternative methods to increase the friction between torque-tool body 1 and the user's hand.

A bottom surface of the attachment body 10 may be tapered away from the engagement bore 11 so that the plurality of paired engagement features 3 can be driven into the damaged/stripped fastener head by a hammer, without hitting or damaging the engagement bore 11. In other words, depending on the user's preference a diameter of the attachment body 10 about the engagement bore 11 may be slightly larger than a diameter of the attachment body 10 about the torque-tool body 1 so that the bottom surface of the attachment body 10 can be tapered away from the engagement bore 11. In some embodiments of the present invention, the attachment body 10 may not comprise the engagement bore 11 as the attachment body 10 itself functions as the engagement feature between the present invention and the external torque force. The attachment body 10 may be an external Hex or square able to have torque applied by an external torque tool such as wrench, socket, or pliers. An alternative attachment body 10 may incorporate a wrench handle wherein the wrench handle may preferably be diametrically connected to the torque tool body 1. In other words, the wrench handle would be connected perpendicular to the torque tool body 1 and the rotational axis 2.

Additionally, a wrench handle can be peripherally connected to the torque-tool body 1, wherein the wrench handle functions as the external torque applying tool. With respect to the female torque tool body 1, each of the plurality of paired engagement features 3 is extended along a specific length of the torque-tool body 1 thus delineating an empty space within the torque-tool body 1. The aforementioned empty space functions as a receptive cavity for the fastener head so that the plurality of paired engagement features 3 can grip the lateral surface of the fastener head. The present invention further comprises a fastener-receiving hole that traverses through the torque-tool body 1. The fastener-receiving hole, perpendicular to the rotational axis 2, is positioned opposite the wrench handle and across the torque-tool body 1 thus providing a lateral opening to engage the plurality of paired engagement features 3.

The attachment body 10 can also incorporate a quick connect feature that is typically used in drills, impact drivers, and screwdriver attachments.

Figure 3:
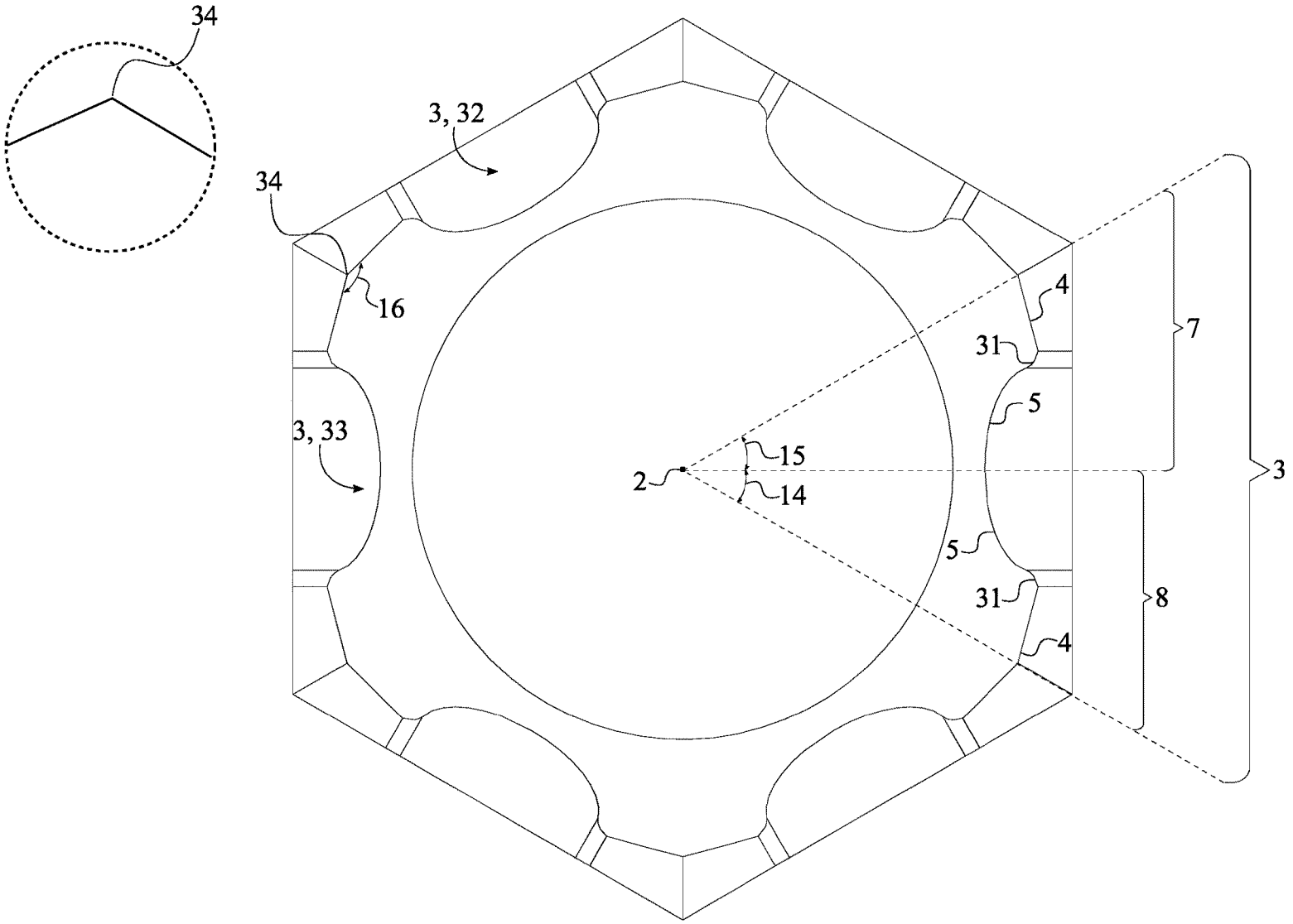
FIG. 3 is a top view of the present invention, wherein the torque-tool body is outwardly extended from the rotational axis to the plurality of paired engagement features.

The plurality of paired engagement features 3 is equally spaced about the torque-tool body 1 to create an enclosed profile as seen in FIG. 3 and FIG. 8. In order to configure the enclosed profile, the plurality of paired engagement features 3 comprises a first engagement feature 7, a second engagement feature 8, and a bisecting line 6.

Furthermore, a cross section for the first engagement feature 7 and the second engagement feature 8 each comprises a bracing section 4, a cavity section 5, a connector section 31 as shown in FIG. 3 and FIG. 8. More specifically, the bracing section 4 and the cavity section 5 are adjacently connected to each other by the connector section 31 thus delineating a single engagement feature that cuts into the fastener head during the removal of the damaged/stripped fastener. The connector section 31 is preferably a small convex, however the connector section 31 may be angular or concave in shape. The connector section 31 may further be a sharp intersecting point. It is preferred that the connector section 31 is shorter in length than the bracing section 4 or the cavity section 5 of the first engagement feature 7 and the second engagement feature 8; however, the connector section 31 may be any length ratio with the other components within the first engagement feature 7 and the second engagement feature 8. In some embodiments, the bracing surface 4, the connector section 31, and the first portion of the cavity section 5 are contiguous and colinear. Within the aforementioned single male engagement feature, the bracing section 4 functions as the third engagement feature, the cavity section 5 functions as the first engagement feature, and the connector section 31 functions as the second engagement feature. However, it is understood that in a female embodiment of the present invention the order of the paired engagement features 3 is reversed. Additionally, the order of the paired engagement features 3 is not limited to the aforementioned order as in certain embodiments or applications or fasteners the order may be any sequence. For example, in certain situations the order of the paired engagement features 3, the connector section 31 may be the first engagement feature. When torque force is applied to the torque-tool body 1, the fastener head may engage with the first engagement feature, the second engagement feature, or the third engagement feature of the single engagement feature or by all three engagement features within the single engagement feature depending on the profile of the fastener head.

In some torque-tool body 1 applications or embodiments, when the bracing section 4 engages with a male fastener, the cavity section 5 remains an empty space. In other words, the bracing section 4 of the plurality of paired engagement features 3 engages with the fastener, however the cavity section 5 does not engage with the fastener head but rather becomes a void, thus allowing greater force to be applied to the fastener surface by way on the bracing section 4 of the plurality of paired engagement features 3. Even though the bracing section 4 from the arbitrary paired engagement feature 32 and the bracing section 4 of the adjacent paired engagement feature 33 both may engage simultaneously with a fastener surface, the torque force of the first engagement feature 7 and the second engagement feature 8 alternate within the enclosed profile to become intermittent depending on the rotation direction of the tool. In other words, when the first engagement features 7 engage with the fastener and torque force is applied, the second engagement features 8 become intermittent. Alternatively, when the second engagement features 8 engage with the fastener and torque force is applied, the first engagement features 7 become intermittent. The bisecting line 6 separates the first engagement feature 7 and the second engagement feature 8 into equal sections within each of the plurality of paired engagement features 3.

A top surface of the torque-tool body 1 and the bottom surface of the attachment body 10 are positioned opposite of each other across the plurality of paired engagement features 3, wherein the top surface and the bottom surface are configured as flat surfaces.

The length of the bracing section 4 and the cavity section 5 and the corresponding angles between the bracing section 4 and the cavity section 5 may vary to create a sharper tooth-like shape for the engagement feature. The first engagement feature 7 is any feature within the plurality of paired engagement features 3 in such a way that the second engagement feature 8 is the feature directly next to the first engagement feature 7 within corresponding the plurality of paired engagement features 3. More specifically, the cavity section 5 of the first engagement feature 7 is adjacently connected to the cavity section 5 of the second engagement feature 8. As shown in FIG. 1-7 the cavity section 5 of the first engagement feature 7 and the cavity section 5 of the second engagement feature 8 are oriented towards the rotational axis 2 thus collectively delineating a radial profile, preferably a partially circular shape or an oval shape, but may also be an angular profiled shape such as triangular, trapezoidal, square but not limited to these shapes. The cavity section 5 may also be a combination of shapes joined together If preferred for manufacturing purposes the shapes or components may be joined by a radial profile. The bracing section 4 of the first engagement feature 7 and the bracing section 4 of the second engagement feature 8 are oppositely positioned of each other about the cavity section 5 of the first engagement feature 7 and the cavity section 5 of the second engagement feature 8 and are oriented away from the rotational axis 2. In other words, the cavity section 5 of the first engagement feature 7 and the cavity section 5 of the second engagement feature 8 are adjacently positioned in between the bracing section 4 of the first engagement feature 7 and the bracing section 4 of the second engagement feature 8.

In reference to FIG. 1-9, a first length ratio between the bracing section 4 of the first engagement feature 7 and the cavity section 5 of the first engagement feature 7 is 1:2. The bracing section 4 of the first engagement feature 7 is preferably a flat surface; however, the bracing section 4 of the first engagement feature 7 may also be a camber surface or a concave surface. A second length ratio between the bracing section 4 of the second engagement feature 8 and the cavity section 5 of the second engagement feature 8 is 1:2. The bracing section 4 of the second engagement feature 8 is preferably a flat surface; however, the bracing section 4 of the second engagement feature 8 may also be a camber surface or a concave surface.

Figure 4:
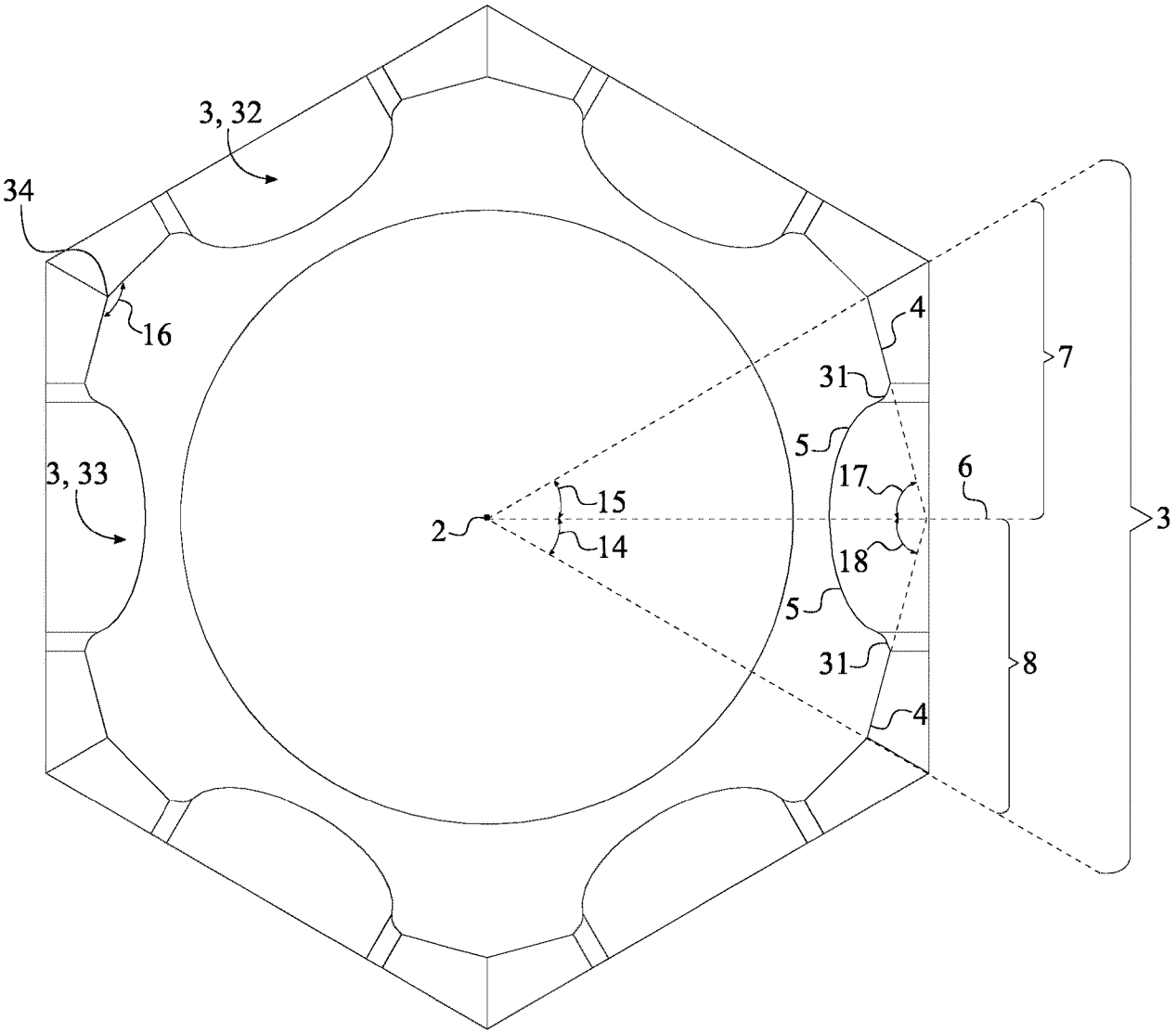
FIG. 4 is a top view of the present invention, wherein the torque-tool body is outwardly extended from the rotational axis to the plurality of paired engagement features and showing the curved section for the connector section, the bisecting line, the first bisecting angle, and the second bisecting angle.
Figure 5:
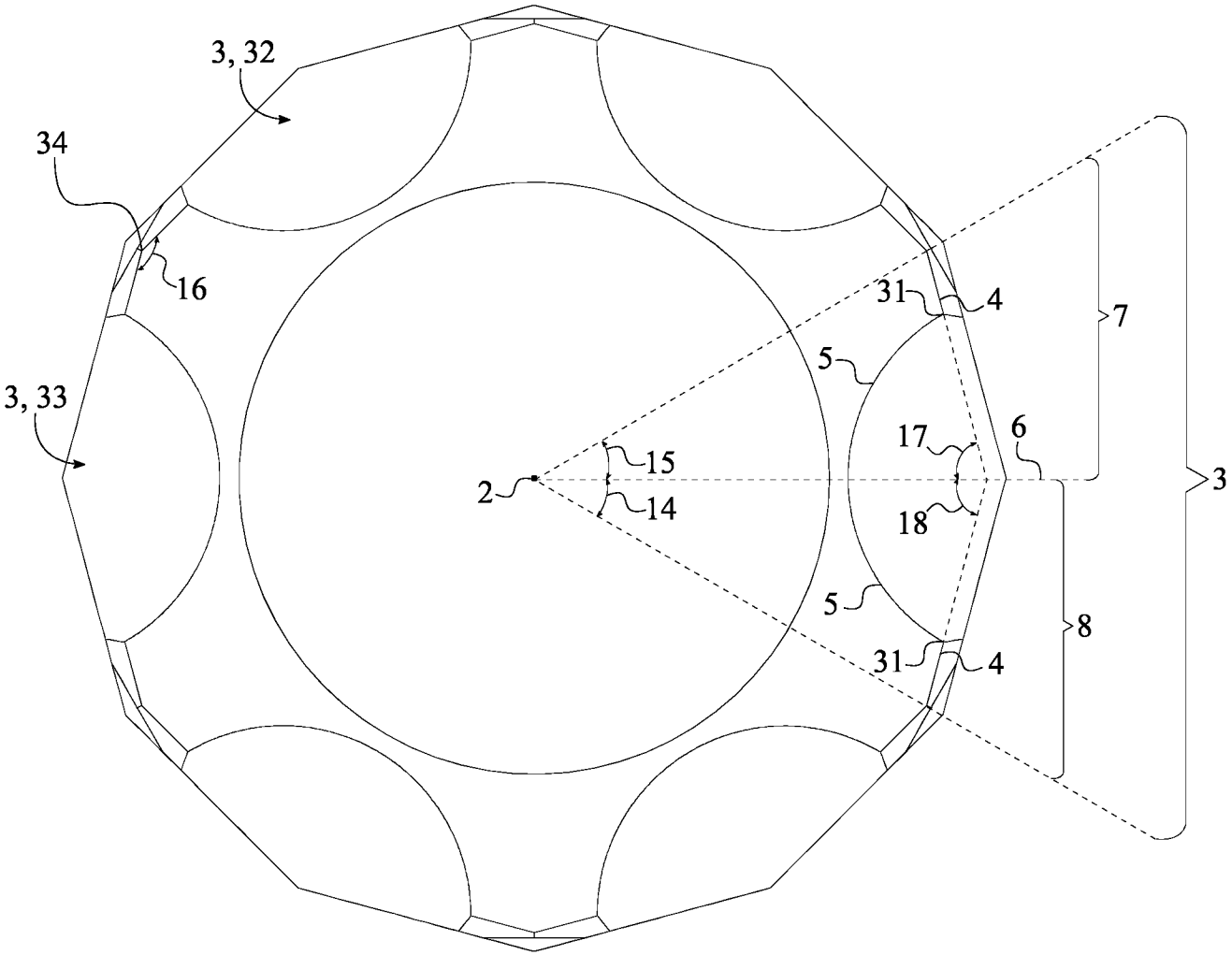
FIG. 5 is a top view of the present invention, wherein the torque-tool body is outwardly extended from the rotational axis to the plurality of paired engagement features and showing the sharp point for the connector section, the bisecting line, the first bisecting angle, and the second bisecting angle.

In reference to FIG. 4, the connector section 31 is delineated as the meeting point of the cavity section 5 and the bracing section 4 of the first engagement feature 7 and as the meeting point of the cavity section 5 and the bracing section 4 of the second engagement feature 8. Depending upon different embodiments of the present invention, the connector section 31 may be a sharp point or a smooth point (curved section) as preferred by the user. Furthermore, the connector section 31 is preferably a convex segment and oriented away from the rotational axis 2. However, the connector section 31 can also be a flat segment, a concave segment, or may connect with the bracing section 4 at an obtuse angle as shown in FIG. 5. The connector section 31 is a novel improvement to the interchange between the flat bracing section 4 and the cavity section 5, wherein the connector section 31 gives the user an additional engagement surface. The additional engagement surface delineated as the connector section 31 provides the user the option to alter the tool to a sharp connector section 31 for greater grip. Alternatively, a radial flat or concave surface gives the user greater surface contact when torque is applied.

Furthermore, a first bisecting angle 17 of the present invention is delineated between the connector section 31 of the first engagement feature 7 and the bisecting line 6 as shown in FIG. 4. Depending upon different embodiment of the present invention, the first bisecting angle 17 can be an acute angle, a right angle, and an obtuse angle.

Furthermore, a second bisecting angle 18 of the present invention is delineated between the connector section 31 of the second engagement feature 8 and the bisecting line 6 as shown in FIG. 4. Depending upon different embodiment of the present invention, the second bisecting angle 18 can be an acute angle, a right angle, and an obtuse angle.

Due to the angular positioning of the first bisecting angle 17 and the second bisecting angle 18, when an imaginary straight line is drawn in between the connector section 31 of the first engagement feature 7 and the connector section 31 of the second engagement feature 8, the imaginary straight line is positioned perpendicular to the bisecting line 6.

Furthermore, the first bisecting angle 17 and the second bisecting angle 18 are collectively combined into an angle less than 180 degrees when a first imaginary line is draw parallel to the bracing section 4 of the first engagement feature 7 and intersected through the connector section 31 of the first engagement feature 7, and a second imaginary line is draw parallel to the bracing section 4 of the second engagement feature 8 and intersected through the connector section 31 of the first engagement feature 7.

Furthermore, the bracing section 4 of the first engagement feature 7 and the bracing section 4 of the second engagement feature 8 are positioned offset of each other. More specifically, the present invention further comprises a first geometric plane and a second geometric plane. The first geometric plane is positioned parallel to the bracing section 4 of the first engagement feature 7, and the second geometric plane that is positioned parallel to the bracing section 4 of the second engagement feature 8 as the first geometric plane and the second geometric plane are positioned offset of each other. In other words, the first geometric plane and the second geometric plane are not co-planer within the present invention. More specifically, the bracing section 4 of the first engagement feature 7 and the bracing section 4 of the second engagement feature 8 are not aligned with each other. Additionally, a geometric plane of the bracing section 4 is preferably not aligned with the plane of a fastener bracing surface for female versions and the male version of the present invention.

Figure 6:
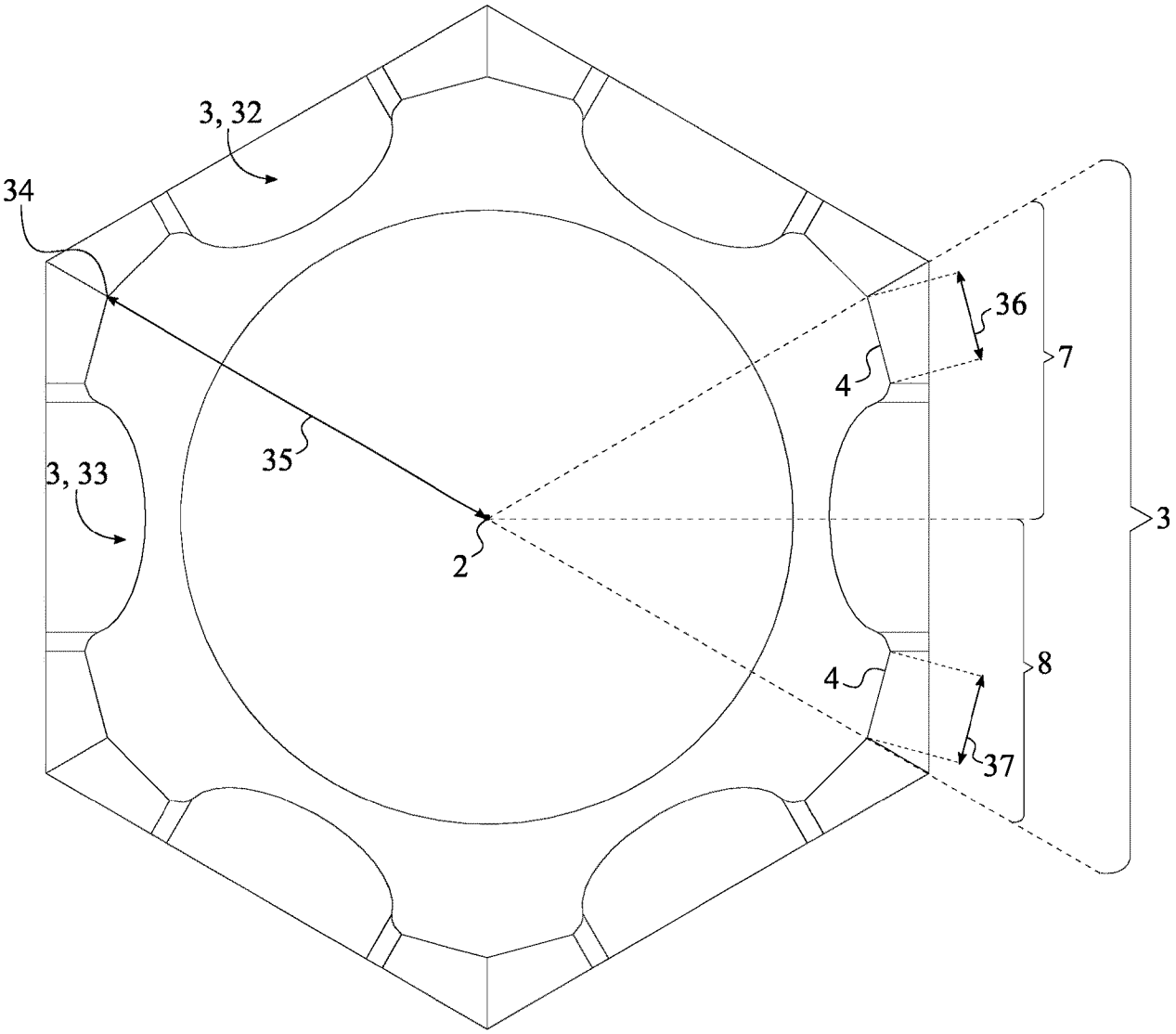
FIG. 6 is a top view of the present invention, wherein the torque-tool body is outwardly extended from the rotational axis to the plurality of paired engagement features and showing the radial distance of the intersection point, the first-length, and the second length of the present invention.
Figure 7:
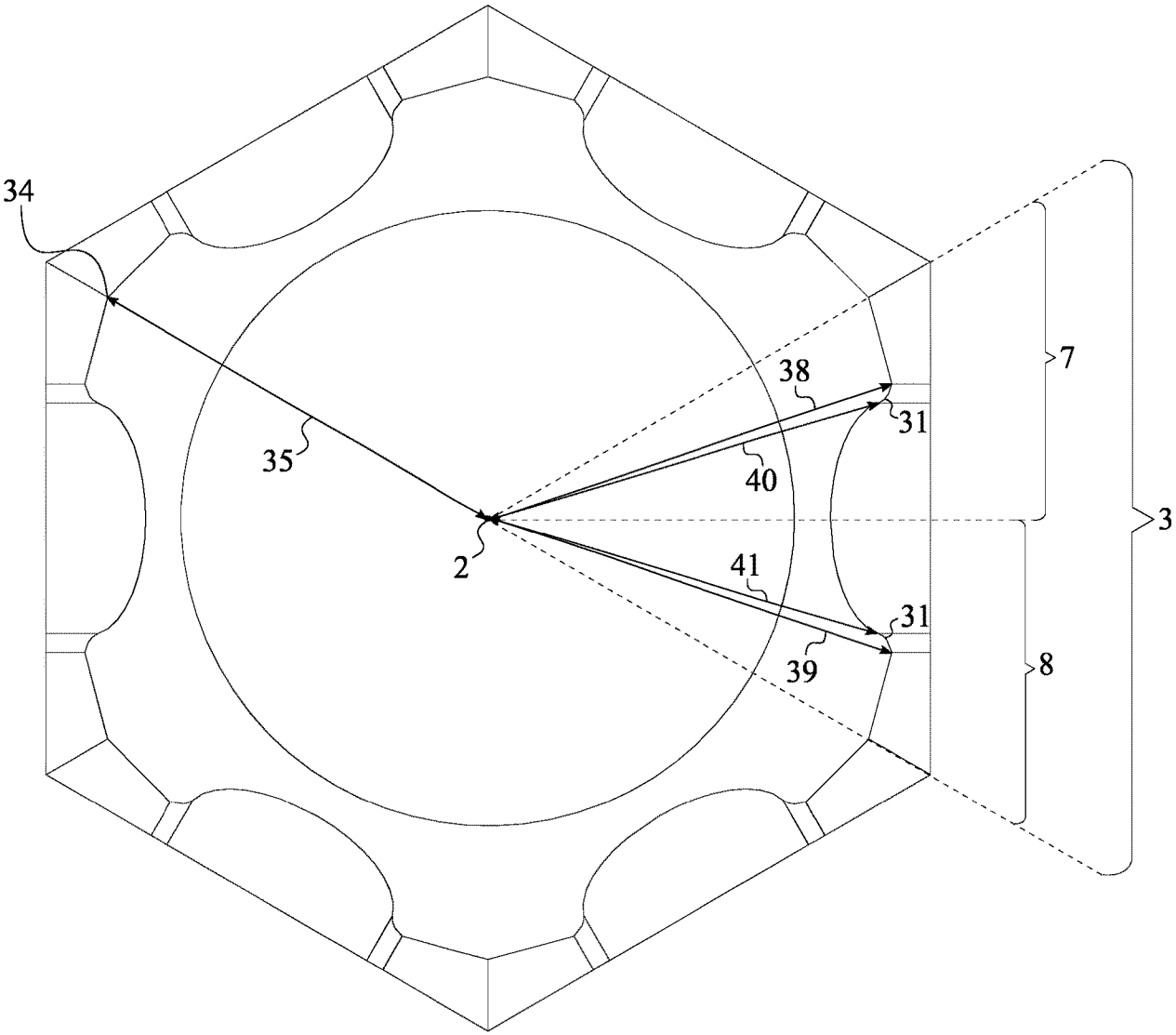
FIG. 7 is a top view of the present invention, wherein the torque-tool body is outwardly extended from the rotational axis to the plurality of paired engagement features and showing the radial distance of the intersection point, the radial distance for the connector section of the first engagement feature, and the radial distance for the connector section of the second engagement feature of the present invention.

Furthermore, a radial distance 35 of the intersection point 34 is 4 to 12 times larger than a first-length 36 for the bracing section 4 of the first engagement feature 7 or a second-length 37 for the bracing section 4 of the second engagement feature 8 as shown in FIG. 6. Furthermore, the radial distance 35 of the intersection point 34 is larger than a radial distance 38 for the connector section 31 connected to the bracing surface 4 of the first engagement feature 7 and a radial distance 39 for the connector section 31 of the second engagement feature 8 as shown in FIG. 7. Additionally, the radial distance 38 is greater than a radial distance 40 for the connector section 31 connected to the cavity section 5 of the first engagement feature 7 and a radial distance 39 is greater than a radial distance 41 the connector section 31 connected to cavity section 5 of the second engagement feature 8 as shown in FIG. 7.

In reference to FIG. 3 and FIG. 8, preferably, the number of the plurality of paired engagement features 3 in contact with the fastener head is six as the six paired engagement features 3 is equal to 12 single engagement features. A first angle 14 between the first engagement feature 7 is 30 degrees and a second angle 15 between the second engagement feature 8 is 30 degrees. Furthermore, in reference to FIG. 3, a third angle 16 between each of the plurality of paired engagement features 3 ranges between 121-179 degrees. As a result, an angular orientation between each of the plurality of paired engagement features 3 can be changed according to different embodiments of the present invention. More specifically, some embodiment of the present invention, the third angle 16 can be 130 degrees. Some embodiments of the present invention, the third angle 16 can be 135 degrees. Some embodiments of the present invention, the third angle 16 can be 145 degrees. Some embodiments of the present invention, the third angle 16 can be 150 degrees.

In some embodiments of the present invention, the plurality of paired engagement features 3 can be tapered away from the rotational axis 2. In other words, an outer diameter of the plurality of paired engagement features 3 about the top surface of the torque-tool body 1 is smaller than an outer diameter of the plurality of paired engagement features 3 about the attachment body 10. Additionally, the cavity section 5 of the first engagement feature 7 and the cavity section 5 of the second engagement feature 8 become narrower and shallower from the top surface of the torque-tool body 1 to the attachment body 10. Even though the cavity section 5 of the first engagement feature 7 and the cavity section 5 of the second engagement feature 8 collectively delineate a circular shaped profile, the present invention is not limited to the circular shaped profile and can be other type of geometric shapes. For example, the cavity section 5 of the first engagement feature 7 and the cavity section 5 of the second engagement feature 8 can delineate a triangular shaped profile within the corresponding bracing sections 4.

To remove the damaged/stripped fastener with the present invention, the torque-tool body 1 is positioned around the damaged/stripped fastener so that a significant portion of the plurality of paired engagement features 3 is positioned around or within the fastener head. The user then simply applies torque force to the torque-tool body 1 in order to rotate and remove the damaged/stripped fastener. When a torque force is applied to the torque-tool body 1, the plurality of paired engagement features 3 "bite" into the lateral sides of fastener head which in turn rotates the damaged/stripped fastener. The present invention is designed to engage partially or fully compromised fastener heads. The present invention overcomes slippage of the fastener head through the use of the plurality of paired engagement features 3.

The present invention is able to drive a fastener on cavity section 5 of the first engagement feature 7 and the cavity section 5 of the second engagement feature 8 in a corresponding lobular fastener design such as Torx, as well as drive a fastener on the outer bracing surface of a socket fastener through the bracing sections 4 of the first engagement feature 7 and bracing sections 4 of the second engagement feature 8.

It is understood that in an alternative embodiment containing all the components of the present invention can be mirror reversed to create female versions of the present embodiments. In other words, the female versions of the present invention would incorporate all the features, function and elements of the present invention but would be a female embodiment. The engagement features in the female embodiment would engage a male fastener lateral surfaces or sidewall. Whereas the protuberance on male version driver tool is orientated away from the rotational axis 2, the protuberance on the female driver tool is orientated towards the rational axis 2. Specifically, in a male embodiment, the bracing section 4 and the connector section 31 in the FIG. 1-7 are oriented away from the rotational axis 2 whereas in FIG. 8-9 the female embodiment, the bracing section 4 and the connector section 31 are oriented towards the rotational axis 2.

In the present invention, the length of the bracing section 4 and the cavity section 5 and the corresponding angles between the bracing section 4 and the cavity section 5 may vary to create a sharper tooth-like shape for the plurality of paired engagement features 3. Specifically, the bracing section 4 of the first engagement feature 7 may be greater in length then a length of the bracing section 4 of the second engagement feature 8, or the bracing section 4 of the second engagement feature 8 may be greater in length than a length of the bracing section 4 of first engagement feature 7 to create a sharp aggressive engagement, or less aggressive dull engagement as preferred by the user. The first engagement feature 7 is any feature within the plurality of paired engagement features 3 in such a way that the second engagement feature 8 is the feature directly next to the first engagement feature 7 within corresponding the plurality of paired engagement features 3. More specifically, the cavity section 5 of the first engagement feature 7 is adjacently connected to the cavity section 5 of the second engagement feature 8. As shown in FIG. 8-9, the intersection point 34 is identified as the meeting points of two of the plurality of paired engagement features 3. In other words, an arbitrary paired engagement feature 32 from the plurality of paired engagement features 3 and an adjacent paired engagement feature 33 from the plurality of paired engagement features 3 are connected to each other through the intersection point 34. Depending upon different embodiments of the present invention, the intersection point 34 can be a sharp point or a curved section similar to a small radius. In some embodiment, the intersection point 34 may incorporate a third segment, wherein the third segment is preferably a straight portion connected between the plurality of paired engagement features 3 of the arbitrary bracing section 4 and the adjacent bracing section 4. Furthermore, the radial distance 35 of the intersection point 34 is 4 to 12 times larger than the first-length 36 for the bracing section 4 of the first engagement feature 7 or the second-length 37 for the bracing section 4 of the second engagement feature 8 as shown in FIG. 8. Furthermore, the radial distance 35 of the intersection point 34 is less than a radial distance 42 for the connector section 31 of the first engagement feature 7 and/or a radial distance 43 for the connector section 31 of the second engagement feature 8 as shown in FIG. 8. The connector section 31 is delineated as the meeting point of the cavity section 5 and the bracing section 4 of the first engagement feature 7 and as the meeting point of the cavity section 5 and the bracing section 4 of the second engagement feature 8. Depending upon different embodiments of the present invention, the connector section 31 may be a sharp point or a smooth point (curved section) as preferred by the user. In some embodiments, the bracing surface 4, the connector section 31, and the first portion of the cavity section 5 are contiguous and colinear. Furthermore, the connector section 31 is preferably a convex segment and oriented towards the rotational axis 2. However, the connector section 31 can also be a flat segment, a concave segment, or may connect with the bracing section 4 at an obtuse angle as shown in FIG. 8. The connector section 31 is a novel improvement to the interchange between the flat bracing section 4 and the cavity section 5, wherein the connector section 31 gives the user an additional engagement surface. The addition engagement surface delineated as the connector section 31 provides the user the option to alter the tool to a sharp connector section for greater grip, alternatively, a radial, flat, or concave surface gives the user greater surface contact when torque is applied.

As shown in FIG. 8-9 the cavity section 5 of the first engagement feature 7 and the cavity section 5 of the second engagement feature 8 are oriented away from the rotational axis 2 thus collectively delineating a radial profile, preferably a partially circular shape or an oval shape but may also be an angular profiled shape such as triangular, trapezoidal, square but not limited to these shapes. The cavity section 5 may also be a combination of shapes joined together If preferred for manufacturing purposes the shapes or components may be joined by a radial profile. The bracing section 4 of the first engagement feature 7 and the bracing section 4 of the second engagement feature 8 are oppositely positioned of each other about the cavity section 5 of the first engagement feature 7 and the cavity section 5 of the second engagement feature 8 and are oriented towards the rotational axis 2. In other words, the cavity section 5 of the first engagement feature 7 and the cavity section 5 of the second engagement feature 8 are adjacently positioned in between the bracing section 4 of the first engagement feature 7 and the bracing section 4 of the second engagement feature 8. In some embodiments of the present invention, the plurality of paired engagement features 3 can be tapered away from the rotational axis 2. In other words, an outer diameter of the plurality of paired engagement features 3 about the top surface of the torque-tool body 1 is greater than an outer diameter of the plurality of paired engagement features 3 about the attachment body 10. Furthermore, as shown in FIG. 8-9, the bracing section 4 of the first engagement feature 7 and the bracing section 4 of the second engagement feature 8 are positioned offset of each other. More specifically, the present invention further comprises a first geometric plane and a second geometric plane. The first geometric plane is positioned parallel to the bracing section 4 of the first engagement feature 7, and the second geometric plane that is positioned parallel to the bracing section 4 of the seconds engagement feature 8 as the first geometric plane and the second geometric plane are positioned offset of each other. In other words, the first geometric plane and the second geometric plane are not co-planer within the present invention. Specifically, the bracing section 4 of the first engagement feature 7 and the bracing section 4 of the second engagement feature 8 are not aligned with each other.

It is understood that all components described within the present application pertaining to the male embodiment of FIG. 1-7 are also applicable to the female embodiment FIG. 8-9 of the present application even if not explicitly described as pertaining to FIG. 8-9 as all components are part of the overall invention in either a female or male configuration. It is further understood that the opposite would be true for components described as pertaining for FIG. 8-9 would also apply to FIG. 1-7.

In reference to FIG. 1-9, in some embodiments, the bracing surface 4 may comprise an intermittent sidewall. The intermittent sidewall may be placed between the plurality of sidewalls with the plurality of paired engagement features 3. The intermittent sidewalls may alternate between the plurality of paired engagement features 3 or may be opposite of each of the plurality of paired engagement features 3. A plurality of intermittent sidewalls may further be a plurality of consecutive intermittent sidewalls. In other words, more than one intermittent sidewall may be placed consecutively between the plurality of paired engagement features 3. The intermittent sidewall surface is preferably a flat surface.

Although the invention has been explained in relation to its preferred embodiment, it is to be understood that many other possible modifications and variations can be made without departing from the spirit and scope of the invention as hereinafter claimed.

What is claimed is:

1. An anti-slip fastener remover tool comprises:

a torque-tool body;

a plurality of paired engagement features;

a plurality of intersection points, wherein each of the plurality of intersection points is a sharp point;

each of the plurality of paired engagement features comprising a first engagement feature and a second engagement feature;

a cross section for the first engagement feature and the second engagement feature each comprising a bracing section, a cavity section, and a connector section, wherein the bracing section is flat;

the plurality of paired engagement features being radially distributed about a rotational axis of the torque-tool body;

the bracing section and the cavity section being connected to each other by the connector section;

the cavity section of the first engagement feature being connected to the cavity section of the second engagement feature;

the cavity section of the first engagement feature and the cavity section of the second engagement feature being oriented towards the rotational axis;

the bracing section of the first engagement feature and the bracing section of the second engagement feature being oppositely positioned of each other about the cavity section of the first engagement feature and the cavity section of the second engagement feature;

an arbitrary paired engagement feature from the plurality of paired engagement features and an adjacent paired engagement feature from the plurality of paired engagement features being connected to each other through a corresponding intersection point from the plurality of intersection points;

a radial distance of the intersection point is larger than a radial distance of each point on the connector section of the first engagement feature on the same cross section as the intersection point; and a radial distance of the intersection point is larger than a radial distance for each point on the connector section of the second engagement feature on the same cross section as the intersection point.

2. The anti-slip fastener remover tool as claimed in claim 1, wherein a first angle between the first engagement feature is 30 degrees, and wherein a second angle between the second engagement feature is 30 degrees.

3. The anti-slip fastener remover tool as claimed in claim 1, wherein a third angle between each of the plurality of paired engagement features ranges between 121-179 degrees.

4. The anti-slip fastener remover tool as claimed in claim 3, wherein the third angle is 130 degrees.

5. The anti-slip fastener remover tool as claimed in claim 3, wherein the third angle is 135 degrees.

6. The anti-slip fastener remover tool as claimed in claim 3, wherein the third angle is 145 degrees.

7. The anti-slip fastener remover tool as claimed in claim 3, wherein the third angle is 150 degrees.

8. The anti-slip fastener remover tool as claimed in claim 1, wherein the connector section is a convex segment, wherein the connector section is oriented away from the rotational axis.

9. The anti-slip fastener remover tool as claimed in claim 1 comprising:

the torque-tool body being outwardly extended from the rotational axis to the plurality of paired engagement features.

10. The anti-slip fastener remover tool as claimed in claim 1, wherein a first length ratio between the bracing section of the first engagement feature and the cavity section of the first engagement feature is 1:2.

11. The anti-slip fastener remover tool as claimed in claim 1, wherein a second length ratio between the bracing section of the second engagement feature and the cavity section of the second engagement feature is 1:2.

12. The anti-slip fastener remover tool as claimed in claim 1, wherein a radial distance of the intersection point being 4 to 12 times larger than a first-length for the bracing section of the first engagement feature.

13. The anti-slip fastener remover tool as claimed in claim 1, wherein a radial distance of the intersection point being 4 to 12 times larger than a second-length for the bracing section of the second engagement feature.

14. The anti-slip fastener remover tool as claimed in claim 1, wherein the bracing section of the first engagement feature and the bracing section of the second engagement feature are positioned offset of each other.

15. The anti-slip fastener remover tool as claimed in claim 1 comprises:

an attachment body;

the attachment body being centrally positioned around and along the rotational axis; and the attachment body being adjacently connected to the torque-tool body.

16. The anti-slip fastener remover tool as claimed in claim 15 comprises:

the torque-tool body being inwardly extended from an outer wall of the torque-tool body to the plurality of paired engagement features;

an engagement bore; and the engagement bore traversing into the attachment body along the rotational axis, opposite of the torque-tool body.

* * * * *